US005984297A

United States Patent [19]

Tanaka

[11] Patent Number: 5,984,297

[45] Date of Patent: Nov. 16, 1999

[54] COMPACTLY ASSEMBLED SHEET FEEDING APPARATUS WITH A MOVABLE PAPER TRAY AND SEPARATING MEMBER

[75] Inventor: Yoshiaki Tanaka, Kawasaki, Japan

[73] Assignee: Ricoh Company, Ltd., Tokyo, Japan

[21] Appl. No.: 08/807,084

[22] Filed: Feb. 27, 1997

[30] Foreign Application Priority Data

Feb. 27, 1996 [JP] Japan ..... 8-039708

[51] Int. Cl.[6] ..... B65H 3/06

[52] U.S. Cl. ..... 271/118; 271/126

[58] Field of Search ..... 271/10.11, 117, 271/118, 121, 126, 114

[56] References Cited

U.S. PATENT DOCUMENTS

| | | | |
|---|---|---|---|
| 3,888,479 | 6/1975 | Eder et al. | 271/118 |
| 3,966,189 | 6/1976 | Taylor et al. | 271/6 |
| 4,025,187 | 5/1977 | Taylor et al. | 271/34 |
| 4,535,981 | 8/1985 | Watanabe et al. | 271/121 |
| 4,991,830 | 2/1991 | Yamanaka | 271/117 |
| 5,004,217 | 4/1991 | Kano et al. | 271/118 |
| 5,052,677 | 10/1991 | Shibata | 271/121 |
| 5,193,797 | 3/1993 | Harada et al. | 271/118 |
| 5,240,242 | 8/1993 | Ando et al. | 271/118 |
| 5,244,191 | 9/1993 | Kanekura | 271/118 |
| 5,253,854 | 10/1993 | Tanoue et al. | 271/118 |
| 5,343,223 | 8/1994 | Tohyama et al. | 346/108 |
| 5,358,230 | 10/1994 | Ikemori et al. | 271/118 |
| 5,372,359 | 12/1994 | Miura et al. | 271/121 |
| 5,386,983 | 2/1995 | Ando | 271/118 |
| 5,543,909 | 8/1996 | Quesnel | 271/228 X |
| 5,596,399 | 1/1997 | Dempsey et al. | 271/245 X |
| 5,655,762 | 8/1997 | Yergenson | 271/121 |
| 5,816,569 | 10/1998 | Hoshi et al. | 271/127 |
| 5,857,671 | 1/1999 | Kato et al. | 271/127 |
| 5,863,036 | 1/1999 | Tanaka et al. | 271/121 X |

FOREIGN PATENT DOCUMENTS 6-39841 5/1994 Japan .

*Primary Examiner*—Christopher P. Ellis
*Assistant Examiner*—Thuy V. Tran
*Attorney, Agent, or Firm*—Oblon, Spivak, McClelland, Maier & Neustadt, P.C.

[57] ABSTRACT

A sheet feeding apparatus for use in an image forming system includes a pivoting tray and a pivoting separating member which press against a feed roller. The movement of the tray and separating member is controlled by a cam having a first cam surface which controls the movement of the tray and a second cam surface which controls the movement of the separating member towards and away from a feed roller. The cam includes a gear having a segment without gear teeth. A spring pushes a third cam surface of the cam in order to rotate the cam so that the portion of the gear of the cam having teeth mesh with an idler gear which imposes a rotational force from a motor onto the cam.

12 Claims, 8 Drawing Sheets

COMPACTLY ASSEMBLED SHEET FEEDING APPARATUS WITH A MOVABLE PAPER TRAY AND SEPARATING MEMBER

BACKGROUND OF THE INVENTION

1. Field of the Invention

The present invention relates to a sheet feeding apparatus for feeding sheets one-by-one, for example to an image forming unit of a printer, a facsimile machine, a copying machine or the like. The invention is more particularly related to a sheet feeding apparatus in which both a paper tray and a separating member which is a frictional surface are separable from a feed roller.

2. Description of the Background

FIG. 10 is an illustration showing an example of a sheet feeding apparatus in a conventional electrophotographic image forming apparatus. A sheet feeding and separating roller 3 which separates and feeds an individual sheet 2 stacked on a paper tray 1 is in pressured contact with a sheet separating member 4 for preventing a double feeding of the sheet 2. A pair of registration rollers 5, a photoconductive drum 6, a transfer roller 7 and the like are disposed downstream in a feeding direction of the sheet 2 of the sheet feeding and separating roller 3.

When the sheet feeding and separating roller 3, the registration rollers 5 and the like are rotatably driven at the start of an image forming operation, the sheet 2 stacked on the tray 1 is fed from the top of the stack towards the sheet separating member 4 by a frictional force of the sheet feeding and separating roller 3 against the sheet 2. If the single sheet 2 is fed, the sheet 2 is fed between the sheet feeding and separating roller 3 and the sheet separating member 4 by the rotational force of the roller 3. However, if more than one sheet is fed from the tray 1, the sheet separating member 4 applies a larger friction force to the lower sheet 2 than the frictional force between the two sheets. Therefore, only one sheet at a side of the sheet feeding and separating roller 3 is fed towards the registration rollers 5 and any other sheets remain unfed.

The sheet 2 separated by the sheet separating member 4 is conveyed to a nip of the photoconductive drum 6 and the transfer roller 7, at a proper time by the registration rollers 5, and a toner image formed on the photoconductive drum 6 is transferred on the sheet 2.

Further, a sheet feeding apparatus disclosed in Japanese Laid-open Utility Model application No. 39841/1994 is explained based on FIG. 11. In this sheet feeding apparatus, a sheet feeding roller 10, made of a material such as rubber feeds a sheet 9 mounted on a tray 8. The sheet feeding roller 10 has a sector shape, and a driven sheet conveying roller 12 is mounted rotatably on a rotating drive shaft 11 of the sheet feeding roller 10. An independent rotating drive shaft 13 is disposed parallel to the rotating drive shaft 11, and a drive sheet conveying roller 14 which contacts the driven sheet conveying roller 12 with pressure is fixed to the shaft 13. Further, a separating member 15 is held rotatably around the rotating drive shaft 13, and the separating member 15 touches the outer peripheral surface of the driven sheet conveying roller 12 with pressure.

In FIG. 10, the feeding and separating roller 3 and the registration rollers 5 are made in independent unitized bodies, and a multiplicity of parts makes it difficult to design a compact size configuration as a result. Further, there is required to provide an independent drive transmission mechanism in each unitized body because the feeding amount and a conveying speed for the sheet have to be controlled in each unitized body. Therefore, construction and synchronization of the parts of the apparatus is complex as a result.

From a point of compact sizing, the sheet feeding apparatus which is shown in FIG. 11 is improved because the sheet feeding roller 10 and the driven sheet conveying roller 12 are mounted on the same shaft in the sheet feeding apparatus. However, a drive force transmission mechanism for the drive sheet conveying roller 14, independent from a drive force transmission mechanism of the sheet feeding roller 10 is needed, and a number of parts is not reduced because the sheet feeding roller 10 and the drive sheet conveying roller 14 are both required to be provided. Accordingly, reducing a number of parts is not realized.

SUMMARY OF THE INVENTION

Accordingly, one object of the present invention is to provide a novel sheet feeding apparatus which reliably feeds individual sheets of paper from a paper tray.

It is a further object of the invention to provide a sheet feeding apparatus which has a reduced number of parts as compared with conventional sheet feeding apparatuses.

It is yet another object of the invention to provide an image forming system utilizing the sheet feeding apparatus of the invention and which optionally omits the use of registration rollers.

These and other objects are accomplished by a sheet feeding mechanism having a feed roller, a paper tray, and a separating member. At the beginning of a feed operation, the paper tray is moved against the feed roller and the feed roller pulls a sheet from the paper tray. The fed sheet passes between a separating member and the feed roller. The separating member functions as a friction surface and prevents a plurality of sheets from being fed by the feed roller. After passing the separating member, the sheet passes between a sheet conveying roller and a feed roller.

A cam is used to control the movement of the paper tray and the separating member. The cam includes a first cam surface which is used to move the paper tray towards and away from the feed roller, and a second cam surface which moves the separating member towards and away from the feed roller.

The cam including the first and second cam surfaces is constructed so that the sheet separating member presses against the feed roller before the paper tray presses towards the feed roller. Alternatively, the cam may be constructed so that the paper tray and separating member press against the feed roller at approximately the same time. As yet another alternative, the cam is constructed so that the separating member presses against or towards the feed roller before a sheet reaches the feed roller.

The cam also includes a third cam surface which receives a force from a spring which urges the cam to rotate. The cam is prevented from moving by the solenoid connected to a pawl type device which mates with a detent on the cam. When the solenoid releases, the spring turns the cam. The cam also includes a gear having a segment without gear teeth. This allows an idler gear to turn and drive the feed roller without driving the cam. When the solenoid releases the cam and the cam rotates, the cam rotates until the gear of the cam meshes with the idler gear. The cam makes one rotation until the cam engages with the solenoid and the segment of the gear of the cam without gear teeth faces the idler gear.

In accordance with the preferred embodiment of the invention, the pressure of the separating member against the feed roller is less than or equal to the pressure of the tray and pages therein against the feed roller.

The construction of the sheet feeding mechanism allows an image forming apparatus to operate without registration rollers, if desired. A paper sensor detects the position of a page which is being fed and allows a controller to synchronize an image forming operation with the feeding or position of the sheet.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
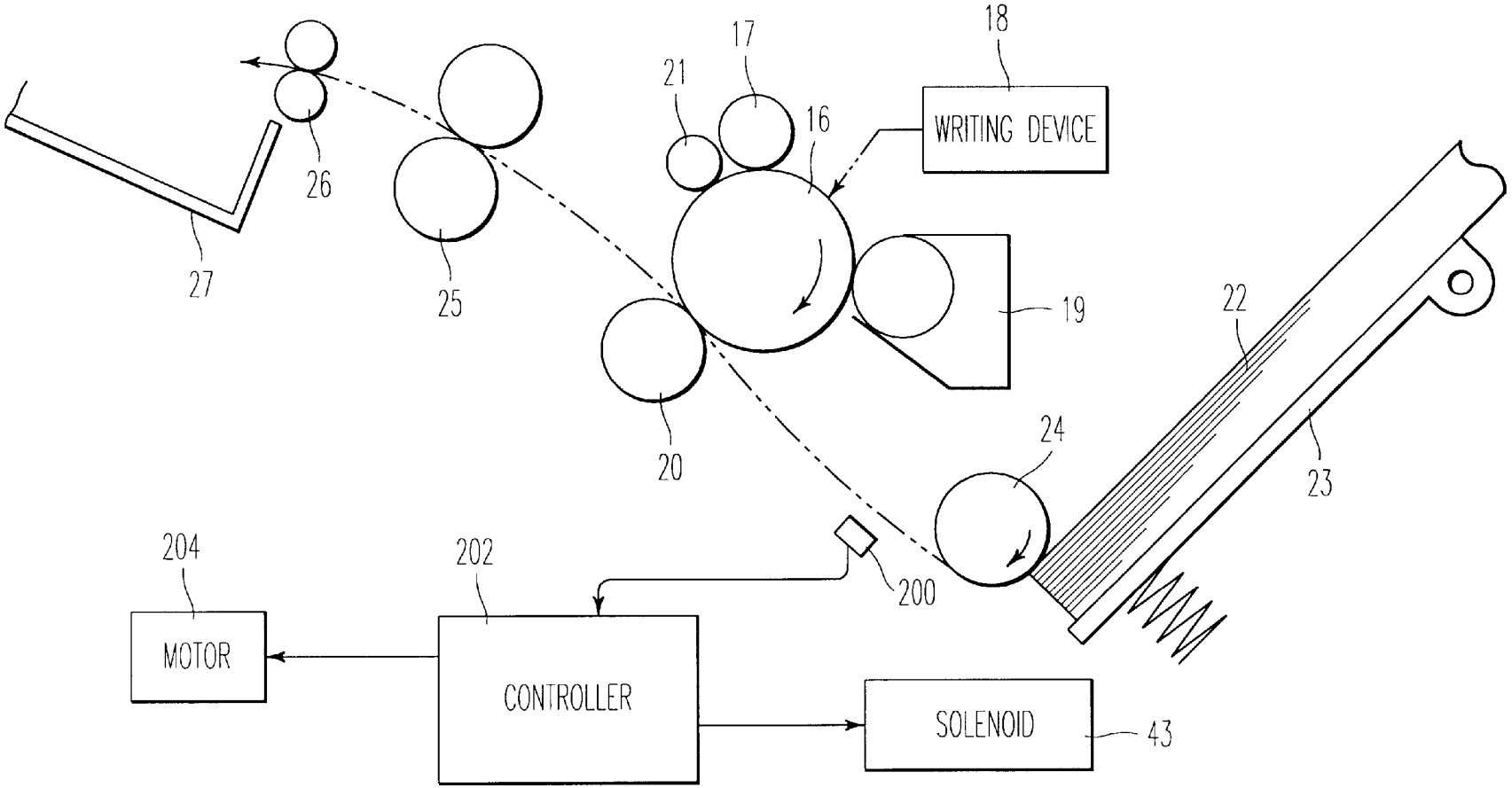
FIG. 1 is a cross-sectional view of a construction of an electrophotographic image forming apparatus constructed in accordance with the teachings of the invention.

Referring now to the drawings wherein like reference numerals designate like or corresponding parts throughout the several views and more particularly to FIG. 1 thereof, there is illustrated an electrophotographic image forming apparatus. The apparatus includes a photoconductive drum 16 having an outer peripheral surface which contacts a charging device or roller 17, an optical writing device 18 which uses for example a laser, a developing device 19 which uses toner, a transferring device or roller 20, and a cleaning device or roller 21 which can alternatively be implemented using a blade. There is a paper tray or tray 23 on which a plurality of sheets 22 is stacked and a sheet feeding roller 24 which feeds the sheets 22 on the tray 23. It is noted that the details of the components surrounding and utilized with the sheet feeding roller 24 are not illustrated in FIG. 1 but are illustrated in detail in FIGS. 2–9. A fixing device 25, a pair of sheet discharging rollers 26, and a sheet discharging tray 27 are disposed downstream in a conveying direction of the sheet 22 from the photoconductive drum 16 and the transferring device 20.

It is possible to operate an image forming apparatus having a sheet feeding apparatus or system constructed in accordance with the teachings of the present invention without using conventional registration rollers, if desired. However, the position of the paper must be synchronized with the image formed on the photoconductive drum 16. The synchronization can be accomplished by using a paper sensor 200 which detects the leading edge of the sheet of paper 22. A controller 202 which may be implemented as a programmed microprocessor or any other desired manner is used to synchronize the paper feeding operation with the image forming operation. The controller 202 receives an input signal from the paper sensor 200, which may be implemented using any type of paper sensor, including, for example, an optical sensor. The controller 202 is connected to a motor 204. (or a plurality of motors) which controls the rotation of the various elements in FIG. 1 and is also connected to a solenoid 43 which starts a paper feeding operation and is further described below. The controller 202 is further used to control the general operation of the image forming apparatus illustrated in FIG. 1 and may also be connected to, for example, the optical writing device 18, the developing device 19, or any other device. Further, it is also possible to implement the controller 202 using a plurality of microprocessors or controllers.

Figure 2:
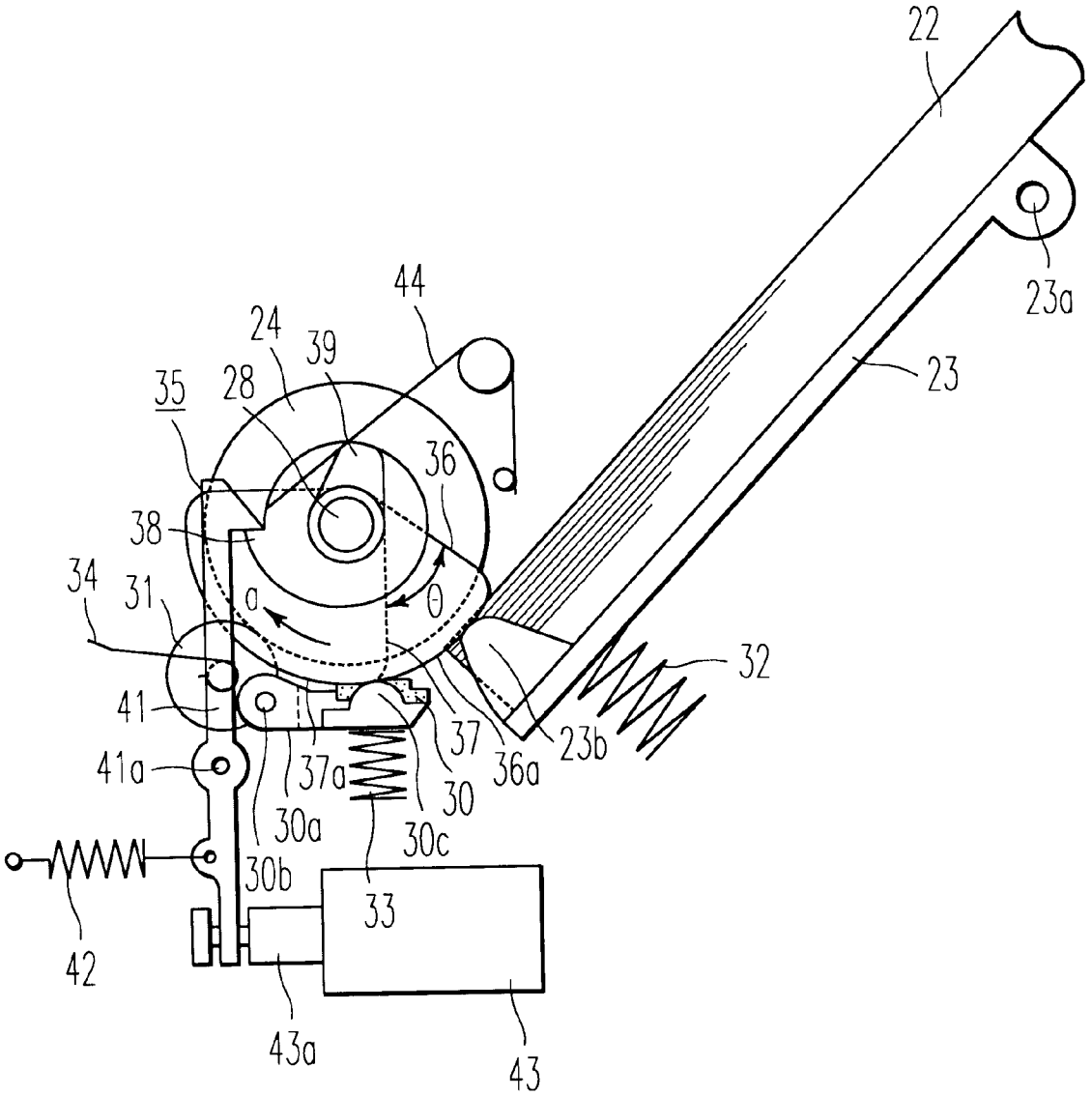
FIG. 2 is a side view showing a first embodiment of the present invention.
Figure 3:
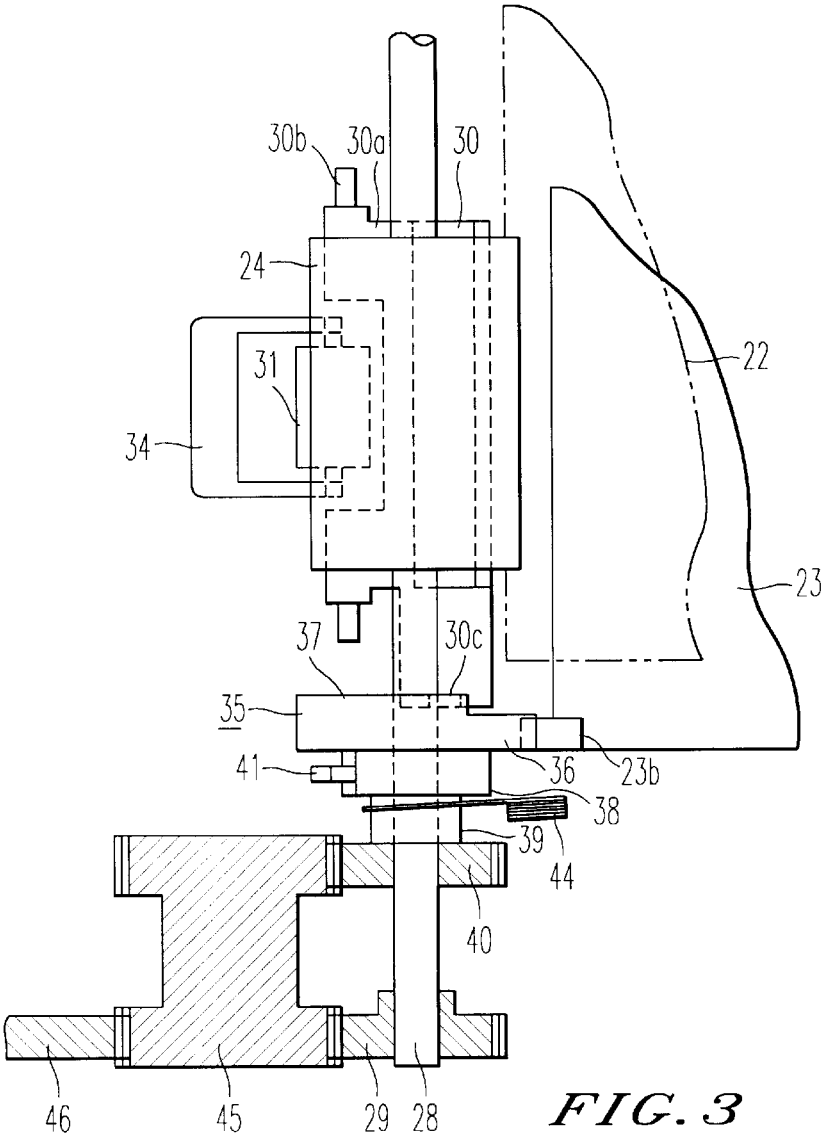
FIG. 3 is a top view showing the first embodiment of the present invention.

FIG. 2 is a side view showing a sheet feeding apparatus of the present invention including the sheet feeding roller 24, and FIG. 3 is a top view of the sheet feeding apparatus. The sheet feeding roller 24 is made of EPDM (Ethylene Propylene Diene Terpolymer) rubbers, urethane rubbers, silicone rubbers or the like in order to surely grip and move the sheet 22, and fixed to a rotation drive shaft 28 which is made of metal or hard resin. A gear 29 is fixed on an end of the rotation drive shaft 28.

At the outer peripheral surface of the sheet feeding roller 24, there is a paper tray or tray 23 holding at least one sheet of paper 22, a sheet separating member 30, and a sheet conveying roller 31. The sheet conveying roller 31 is preferably made of a hard material such as plastic or resin.

The tray 23 is rotatably or pivotally fixed to a rotation shaft 23*a* and moves into and out of contact with the sheet feeding roller 24 by a pivoting action thereof. Further, a pushing spring 32, namely a paper tray or tray pressing member, pushes the tray 23 towards the sheet feeding roller 24.

The sheet separating member 30 which is a frictional surface and implemented using cork, for example, is fixed to a holder 30*a*, and the holder 30*a* is pivotally mounted to a rotation shaft 30*b*. The sheet separating member 30 contacts and is separated from the sheet feeding roller 24 by this pivoting action. Further, a pushing spring 33, i.e., a sheet separating member pushing member, which pushes the sheet separating member 30 against the sheet feeding roller 24 is mounted to the holder 30*a*.

The sheet conveying roller 31 contacts the outer peripheral surface of the sheet feeding roller 24, and is pressed against the outer peripheral surface of the sheet feeding roller 24 by a sheet spring 34.

A cam 35 is rotatably mounted on (e.g. able to rotate about) the rotation drive shaft 28 and therefore is not required to rotate as the shaft 28 rotates. The cam 35 includes a first cam surface 36 and a second cam surface 37, each of which has sector-shaped formation. The cam 35 further includes a hooking portion or detent 38 which acts as part of a ratchet mechanism, a third cam surface which is a pushing force receiving portion and a gear or segmented gear 40 having a section without gear teeth. The cam 35 is preferably integrally formed using a single piece of plastic, resin, or metal, for example, although other materials and constructions such as a plurality of coupled or coupled pieces are possible.

A first contact part 23*b* is a cam follower which contacts the circumference of the first cam surface 36 and is part of or connected to the tray 23. The first contact part 23*b* pushes against the first cam surface 36 by the pushing spring 32. According to a rotation of the cam 35, if the first contact part 23*b* is touching a large diameter part 36*a* of the first cam surface 36, the sheet 22 stacked on the tray 23 does not contact the sheet feeding roller 24, and while the first contact part 23*b* is touching or facing a small diameter part 36*b* or 36*c* of the first cam surface 36, the sheet 22 stacked on the tray 23 contact the outer peripheral surface of the sheet feeding roller 24.

A second contact part 30*c*is a cam follower which contacts the circumference of the second cam surface 37 and is formed in a body with or connected to the holder 30*a*. The second contact part 30*c* is pushed against the circumference of the second cam surface 37 by a pushing force of the pushing spring 33. According to a rotational position of the cam 35, if the second contact part 30*c* is touching a large diameter surface 37*a* of the second cam surface 37, the sheet separating member 30 does not contact the sheet feeding roller 24, and while the second contact part 30*c* is touching or facing a small diameter part 37*b* or 37*c* of the second cam surface 37, the sheet separating member 30 presses against the outer peripheral surface of the sheet feeding roller 24.

In the first embodiment, the shapes from the small diameter part 36*c* to the large diameter part 36*a*, and the small diameter part 37*c* to the large diameter part 37*a* are approximately the same, although other shapes are possible, if desired. Further, the angular position of the first cam surface 36 relative to the second cam surface 37 is retarded by an angle of θ degrees, as illustrated in FIG. 2.

The hooking lever 41 is disposed disengageably at the hooking, ratchet, or detent portion 38 of the cam 35, and is pivotally mounted at a shaft 41*a*. Both of a pulling spring 42 for pulling the hooking lever 41 towards the hooking portion 38 and shaft 28, and a solenoid 43 for pulling the hooking lever 41 away from the detent portion 38 in order to permit the cam 35 to turn, are mounted on the hooking lever 41. A pushing spring 44 presses against the third cam surface 39 of the cam 35 and causes the cam 35 to rotate in a direction a.

Figure 4A:
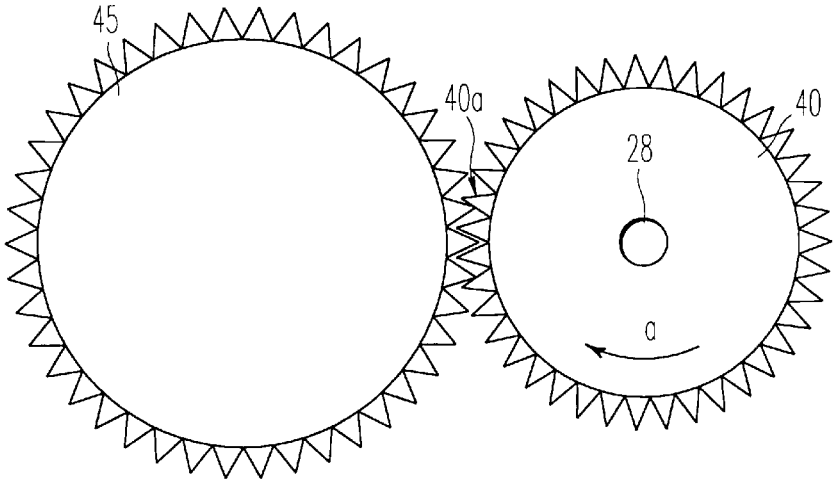
FIG. 4A is a side view showing a positional relation of a segmented gear which has a portion without gear teeth, and an idler gear.

The segmented gear 40 having a segment or section 40*a* without gear teeth is disposed at a position facing an idler gear 45 as shown in FIG. 4A. The idler gear 45 is engaged with the gear 29 as shown in FIG. 3, and a drive gear 46 for transmitting drive force from a drive motor (not shown) is engaged with the idler gear 45.

Figure 8:
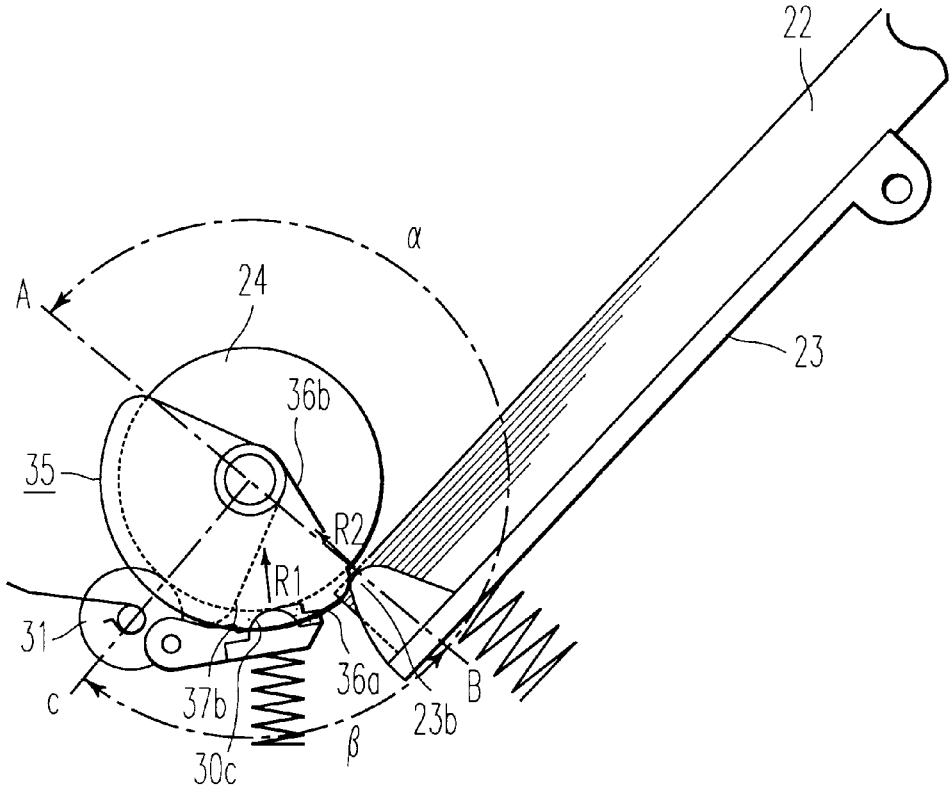
FIG. 8 is a side view showing a state in which both the sheet separating member and the tray contact the sheet feeding roller, after the cam is further rotated.

The pressure of the sheet separating member 30 against the sheet feeding roller 24 due to the pushing spring 33 is R1, and the pressure of the tray 23 against the sheet feeding roller 24 by the pushing spring 32 is R2 as shown in FIG. 8. Preferably, R1 and R2 are in a relation as follows.

$$R| \leq R2$$

Figure 4B:
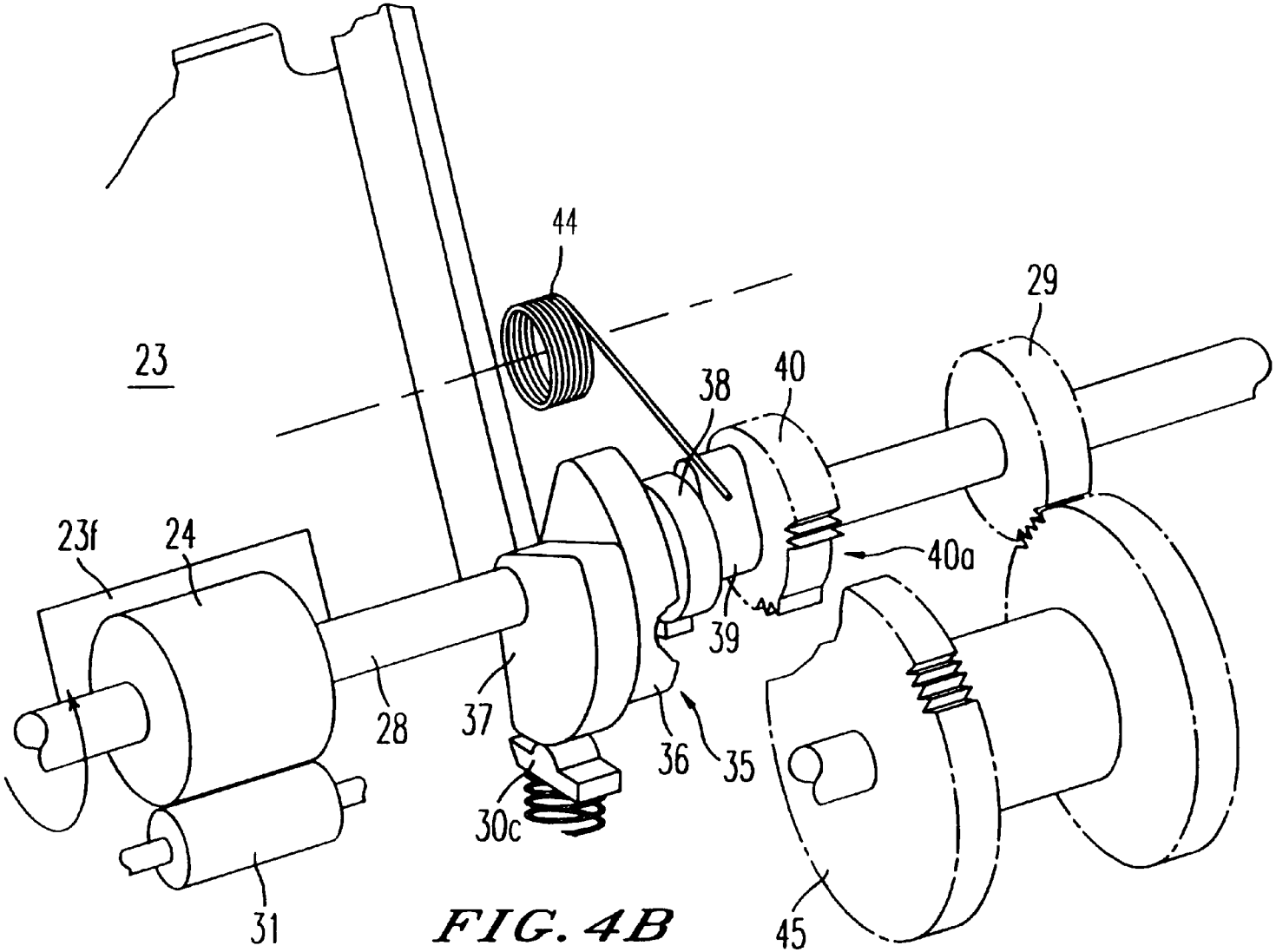
FIG. 4B is a perspective view of a prototype of the invention.

FIG. 4B illustrates a perspective view of a prototype of the invention. This prototype is similar to the first embodiment of the invention as illustrated in FIGS. 2, 3 and 4. However, a difference between this prototype and the illustrations of FIGS. 2 and 3 is that the hooking lever 41 is disposed underneath the shaft 28 instead of to the left of the shaft 28 as illustrated in FIG. 2. Further, the prototype includes a frictional pad 23F made of cork or other material and has a function similar to the sheet separating member 30.

Figure 5:
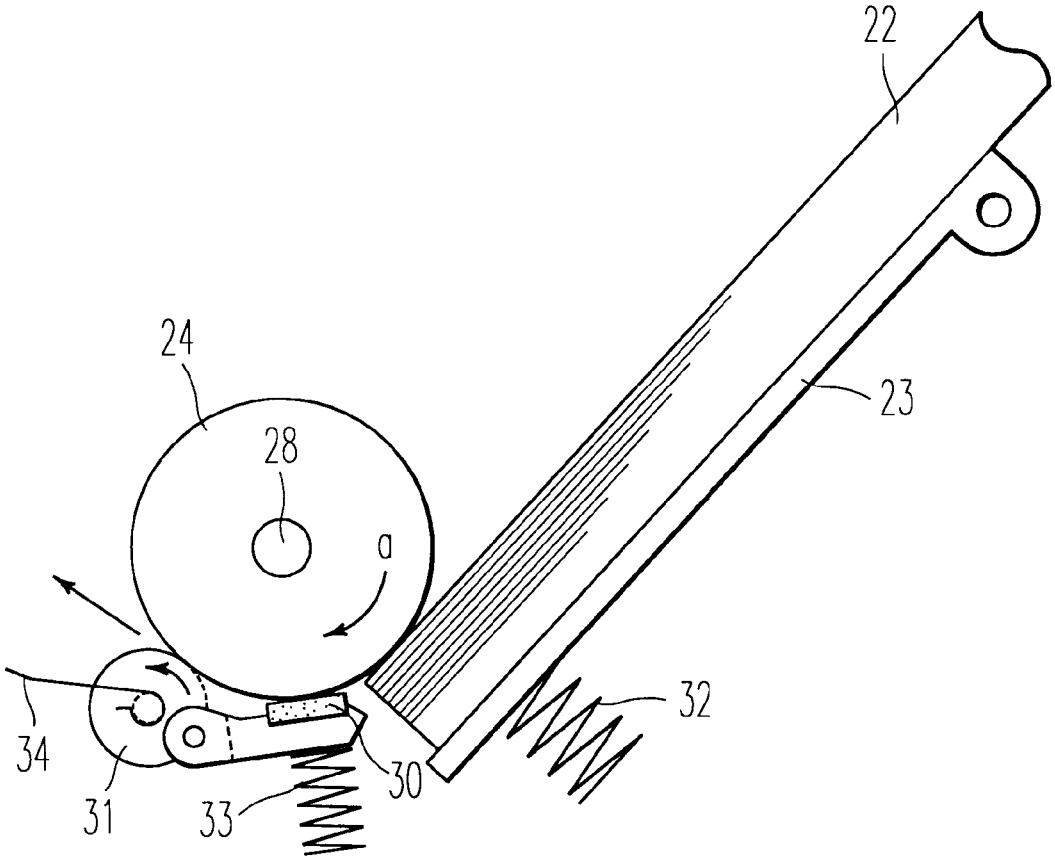
FIG. 5 is a side view showing a fundamental operation of a sheet feeding apparatus.

The fundamental operation of the first embodiment of the sheet feeding apparatus having above-described construction is explained using FIG. 5. When the sheet 22 is stacked on the tray 23, the sheet separating member 30, and the sheet conveying roller 31 are pressed against the sheet feeding roller 24. When the sheet feeding roller 24 is driven in a direction a, the sheet 22 of the uppermost part of the stacked sheets is fed from the tray 23 by a frictional force of the sheet feeding roller 24, and is conveyed between the sheet feeding roller 24 and the sheet separating member 30. If single sheet 22 is fed from the tray 23, the sheet 22 is fed between the sheet separating member 30 and the sheet feeding roller 24 by the rotating force of the sheet feeding roller 24. However, if a plurality of sheets are fed, only one sheet at a side of the sheet feeding roller 24 is fed, while the other sheets at a side of the sheet separating member 30 remain because the frictional force between the sheet separating member 30 and the sheet is larger than the frictional force between two of the sheets. The sheet 22 which is separated by the sheet separating member 30 is conveyed to the photoconductive drum 16 between the sheet feeding roller 24 and the sheet conveying roller 31.

The sheet feeding roller 24 is used for feeding the sheet 22 from the tray 23, for separating the fed sheets, and for conveying the separated sheet 22 within the sheet feeding apparatus. The configuration of the invention allows a reduction of the number of parts and the apparatus has a compact construction. Further, if desired, conventional registration rollers can be eliminated.

FIG. 2 and FIG. 4A denote a stopping or waiting state of the electrophotographic image forming apparatus. The pushing spring 44 pushes against the third cam surface 39 and imparts a rotational force on the cam 35 in a direction indicated by the arrow a. However, because the hooking or detent portion 38 of the cam 35 is hooked by the hooking lever (e.g., a pawl) 41, rotation of the cam 35 is prevented. Further, in the stopping or waiting state, the segment 40a without gear teeth of the gear 40 faces the idler gear 45 as denoted in FIG. 4A.

During the waiting, the first contact part or cam follower 23*b* formed in a body with or connected to the tray 23 contacts the large diameter part 36*a* of the first cam surface 36 and the sheet 22 on the tray 23 does not touch the sheet feeding roller 24. Further, the second contact part 30*c* formed in a body with or connected the holder 30*a* contacts the large diameter part 37*a* of the second cam surface 37 and pushes the sheet separating member 30 away from the sheet feeding roller 24.

Next, when a start signal for feeding the sheet is output from the controller 202 of the electrophotographic image forming apparatus, the gear 29 is rotatably driven via the drive gear 46 and the idler gear 45. The shaft 28 and the sheet feeding roller 24 are driven by the gear 29 in a sheet feeding direction indicated by an arrow a. The solenoid 43 is turned at approximately the same time as the start of the driving of the sheet feeding roller 24. This pivots the hooking lever 41 counter-clockwise around the shaft 41*a* by a pulling motion of a plunger 43*a* of the solenoid 43, thus releasing the hooking state of the hooking lever 41 with the hooking portion or detent 38. Then, the cam 35 is rotated in the direction indicated by an arrow a by the pushing force of the pushing spring 44 against the third cam surface 39 until the teeth on the gear 40 mesh with the idler gear 45. Then, the cam 35 rotates in a direction indicated by an arrow a, due to the engagement of the gears 40 and 45.

Just after starting the rotation of the cam 35, the solenoid 43 is turned off, and the hooking lever 41 pivots about the shaft 41*a* by the pulling force of the pulling spring 42. Therefore, the hooking portion 38 is hooked by the hooking lever 41 when the cam 35 is rotated in one revolution and the cam 35 stops. At this time, the teeth of the gear 40*d* do not mesh with the idler gear 45 and the sheet feeding roller 24 rotates continuously.

Figure 6:
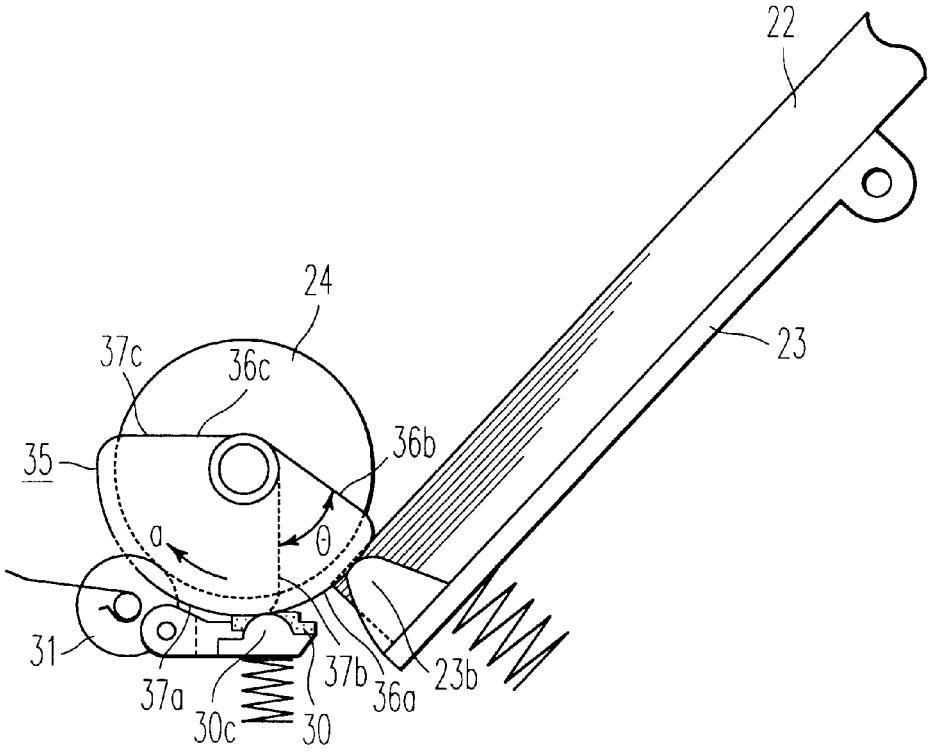
FIG. 6 is a side view showing a non-contact state of both a paper tray and a sheet separating member against a sheet feeding roller just after a sheet feeding instruction is generated from a controller.
Figure 7:
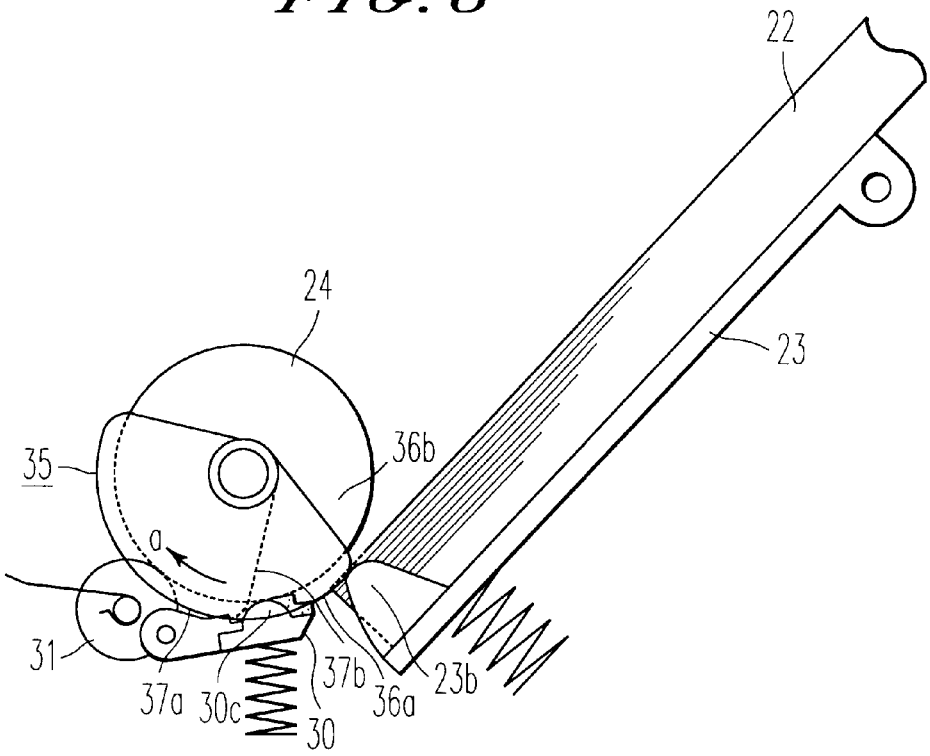
FIG. 7 is a side view showing a state in which the tray does not contact the sheet feeding roller, and the sheet separating member contacts to the sheet feeding roller, after a cam is rotated a predetermined angle.

A sheet feeding operation by the sheet feeding apparatus is explained in detail based upon FIG. 6 through FIG. 8. FIG. 6 illustrates a state just after a start signal for sheet feeding is generated, and the sheet feeding roller 24 and the cam 35 are starting rotation in a direction indicated by an arrow a. The sheet 22 on the tray 23 does not contact the sheet feeding roller 24 because the first contact part or cam follower 23*b* contacts the large diameter part 36*a* of the first cam surface 36. Further, the sheet separating member 30 does not contact the sheet feeding roller 24, since the second contact part or cam follower 30*c* contacts the large diameter part 37*a* of the second cam surface 37. Therefore, the sheet feeding roller 24 is not yet utilized to convey the sheet 22.

FIG. 7 illustrates the cam 35 rotated through a predetermined angle. The second cam follower 30*c* contacts the small diameter part 37*b* of the second cam surface 37, and the sheet separating member 30 contacts the outer peripheral surface of the sheet feeding roller 24. The sheet 22 on the tray 23 is detached from the sheet feeding roller 24, as the first contact part 23*b* contacts the large diameter part 36*a* of the first cam surface 36.

FIG. 8 denotes the cam 35 after further rotation. The second contact part or cam follower 30*c* is facing the small diameter part 37*b* of the second cam surface 37, and the sheet separating member 30 contacts the outer peripheral surface of the sheet feeding roller 24. The sheet 22 is individually fed from the tray 23 by rotating the sheet feeding roller 24, as described above with respect to FIG. 5.

The contacting of the sheet separating member 30 against the sheet feeding roller 24 occurs before the starting movement of the tray 23 against the sheet feeding roller 24 and before the sheet 22 fed from the tray 23 reaches the sheet separating member 30 and the sheet feeding roller 24. Consequently, a malfunction or misfeed of a plurality of sheets between the sheet separating member 30 and the sheet feeding roller 24 before the sheet separating member 30 is pressed against the sheet feeding roller 24 is prevented, and separation of the sheet 22 by the sheet separating member 30 is operated accurately. As a result, a double feeding of the sheet 22 is prevented. The timing of the start of the relative movement of the sheet separating member 30 and the paper tray 23 against the sheet feeding roller 24 is changed by adjusting the angle θ illustrated in FIG. 6.

Next, the movement of the sheet separating member 30 and the tray 23 away from the sheet feeding roller 24 is described. The cam 35 and the sheet feeding roller 24 are rotated at the same angular speed. The sheet 22 is fed from the tray 23 by the sheet feeding roller 24 through β degrees of rotation after the state denoted in FIG. 8. After β degrees of rotation of the cam 35 (and the sheet feeding roller 24) the cam 35 is further rotated through an angle of α degrees, during which the first contact part or cam follower 23*b* contacts the large diameter part 36*a* of the first cam surface 36 so that the tray 23 does not press against the sheet feeding roller 24.

As α>β, the pressure of the tray 23 against the sheet feeding roller 24 is released just after the front edge of the sheet 22 passes between the sheet feeding roller 24 and the sheet conveying roller 31. Therefore, a sheet feeding resistance due to the pressure of the tray 23 against the sheet 22 which starts to be conveyed between the sheet feeding roller 24 and the sheet conveying roller 31 is removed, and conveyability of the sheet 22 and its speed becomes stable. Consequently, jitter caused by unevenness of the conveying sheet of the sheet 22 due to sheet feeding resistance is prevented.

The sheet separating member 30 continues to be pressed against the sheet feeding roller 24 when the pressure of the tray 23 against the sheet feeding roller 24 is released. This is permissible because the pressure R1 of the sheet separating member 30 against the sheet feeding roller 24 is less than or equal to the pressure R2 of the tray 23 against the sheet feeding roller 24. Even though there is resistance due to the pressure of the sheet separating member 30 against the sheet 22, the resistance may be small and stable conveyability of the sheet 22 is obtainable.

In the prototype illustrated in FIG. 4B, the relationships between the position of the cam 35 and the tray 23 and the sheet separating member 30 are as follows. From a time when the solenoid engages allowing rotation of the cam 35 due to the spring 44 until the cam 35 rotates 180°, the tray 23 presses against the sheet feeding roller 24. As the cam 35 rotates between 180° and 270°, the tray 23 is moving away from the sheet feeding roller 24. From an angle of 270° to 360° (back to the starting position of the cam 35), the tray 23 is stationary and positioned away from the sheet feeding roller 24.

With respect to the sheet separating member 30, from the time the cam 35 begins to move due to the force of the spring 44 after release of the cam 35 by the solenoid until the cam 35 rotates 250°, the sheet separating member 30 is in pressured contact against the sheet feeding roller 24. When the cam 35 is rotating from 250° to 260°, the sheet separating member 30 is moving away from the sheet feeding roller 24. From 260° to 360°, the sheet separating member 30 is stationary and positioned away from the sheet feeding roller 24. The above angles are approximate and a deviation of ±5°, 10°, 15°, 20°, or more is possible.

Figure 9:
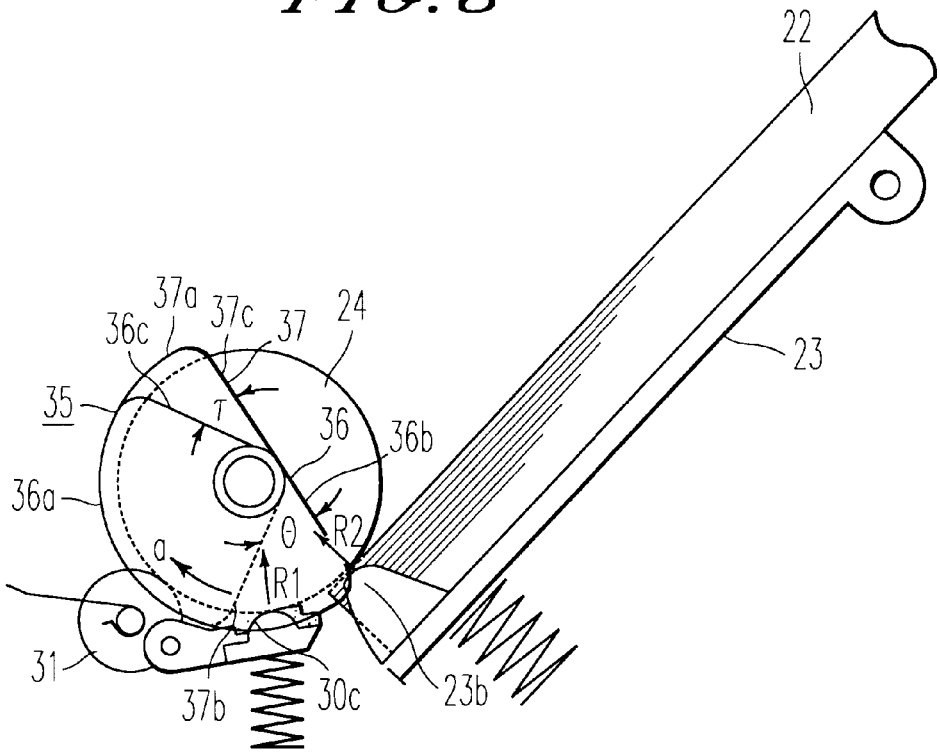
FIG. 9 is a side view showing a second embodiment of the present invention.
Figure 10:
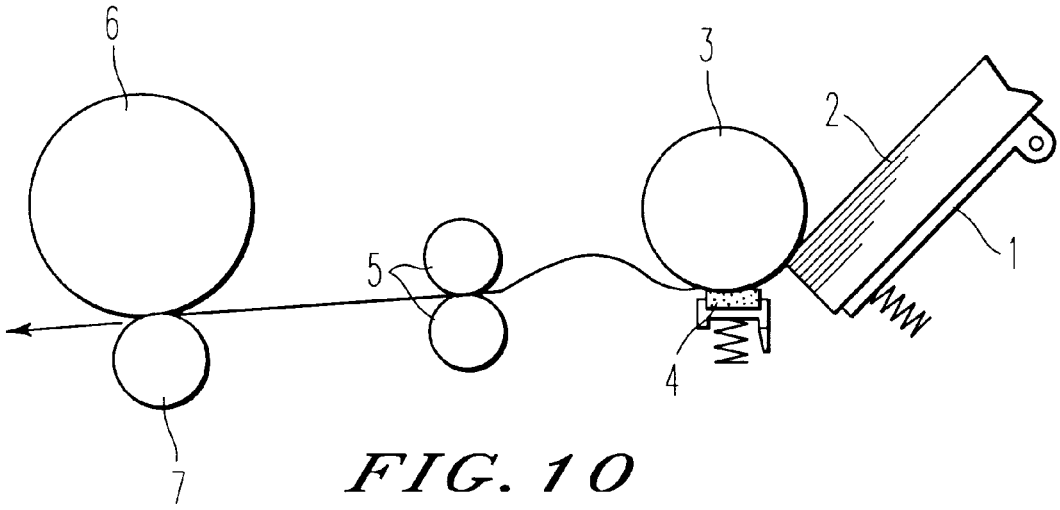
FIG. 10 PRIOR ART
FIG. 10 shows a schematic construction of a conventional sheet feeding apparatus.
Figure 11:
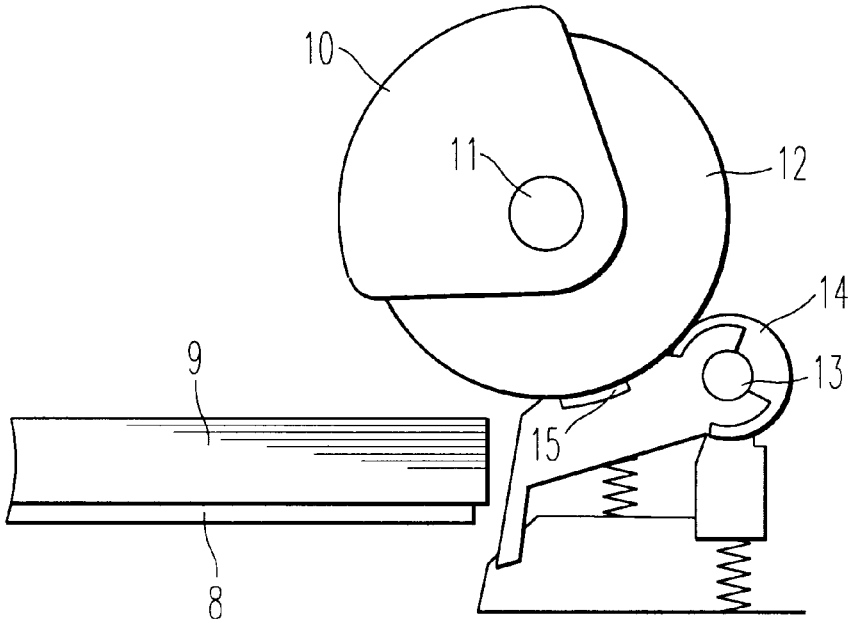
FIG. 11 PRIOR ART
FIG. 11 is a side view showing another conventional sheet feeding apparatus.

Next, the second embodiment of the present invention is described based upon FIG. 9. This embodiment is constructed with a partially changed cam shape of the first cam surface 36 and the second cam surface 37, and other parts are the same as in the first embodiment as shown in FIGS. 1 through 8.

The small diameter part 36*c* to the large diameter part 36*a* of the first cam surface 36 is set back by an angle of γ degrees from the small diameter part 37*c* to the large diameter part 37*a* of the second cam surface 37 in a rotating direction of the cam 35 indicated by an arrow a. This angle of γ degrees is approximately the same as an angle formed by a line from the first contact part 23*b* to the rotation drive shaft 28 and another line from the second contact part 30*c* to the rotation drive shaft 28.

According to the second embodiment, when the cam 35 and the sheet feeding roller 24 are rotated in a direction indicated by the arrow a, the tray 23 and the sheet separating member 30 contact the roller 24 at approximately the same time, due to the contact of the large diameter part 36*a* of the first cam surface 36 with the first contact part or cam follower 23*b* and contact of the large diameter part 37*a* of the second cam surface 37 with the second contact part 30*c* at approximately the same time. Also, a movement of the tray 23 and the sheet separating member 30 away from the sheet feeding roller 24 occur at approximately the same time. Therefore, action of sheet feeding resistance on the sheet 22 by pressing the tray 23 and the sheet separating member 30 against the sheet 22 which is conveyed by the sheet feeding roller 24 and the sheet conveying roller 31 is removed. This allows the conveyability of the sheet 22 to become extremely stable, and jitter caused by unevenness of the conveying speed of the sheet 22 due to sheet feeding resistance is prevented.

The controller of this invention may be conveniently implemented using a conventional general purpose digital computer or microprocessor programmed according to the teachings of the present specification, as will be apparent to those skilled in the computer art. Appropriate software coding can readily be prepared by skilled programmers based on the teachings of the present disclosure, as will be apparent to those skilled in the software art. The invention may also be implemented by the preparation of application specific integrated circuits or by interconnecting an appropriate network of conventional component circuits, as will be readily apparent to those skilled in the art.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A system which feeds paper, comprising:

a feed roller;

a paper tray movable towards and away from the feed roller in order to press a sheet on the tray against the feed roller;

a sheet conveying roller disposed next to and biased towards the feed roller;

a separating member, disposed between the paper tray and the sheet conveying roller, which pushes the sheet against the feed roller to separate any other sheets;

a first cam surface which moves the paper tray towards and away from the feed roller;

a second cam surface which moves the separating member towards and away from the feed roller;

a gear, connected to the first and second cam surfaces, having a section without gear teeth; and a drive gear which drives the gear connected to the first and second cam surfaces.

2. A system according to claim 1, wherein:

the separating member moves away from the feed roller when the sheet is between the feed roller and the sheet conveying roller.

3. A system according to claim 1, further comprising:

a first spring which presses against the tray; and a second spring which presses against the separating member.

4. A system according to claim 3, wherein:

the first spring presses the tray against the feed roller; and the second spring presses the separating member against the feed roller.

5. A system according to claim 4, wherein:

a force of the tray against the feed roller caused by the first spring is greater than or equal to a force of the separating member against the feed roller.

6. A system according to claim 1, further comprising:

a third cam surface connected to the first and second cam surfaces;

a spring which presses the third cam surface and imposes a rotational force on the third cam surface; and a holding mechanism including a detent, connected to the first, second, and third cam surfaces, which prevents the first, second, and third cam surfaces from rotating; and a solenoid which releases the holding mechanism, thereby allowing the first, second, and third cam surfaces to rotate one revolution by a transfer of rotational force from the drive gear to the gear having a section without teeth until the section without teeth is facing the drive gear and the holding mechanism prevents the first, second, and third cam surfaces from further rotating.

7. A sheet feeding system, comprising:

a sheet feeding roller for holding a plurality of sheets; a tray movable towards and away from the sheet feeding roller;

a tray pushing means for pushing the tray towards the sheet feeding roller;

a sheet separating member movable towards and away from the sheet feeding roller;

a sheet separating member pushing means for pushing said sheet separating member towards sheet feeding roller; and a sheet conveying roller rotatably driven by contact with an outer peripheral surface of the sheet feeding roller, wherein the tray, the sheet separating member, and the sheet conveying roller are respectively disposed around said sheet feeding roller with the sheet separating member disposed between the tray and the sheet conveying roller;

a cam which rotates at a predetermined timing when a sheet is fed, the cam being mounted on a shaft which supports the sheet feeding roller, the cam including a first cam surface which moves the tray towards and away from the sheet feeding roller at a predetermined timing when the cam is rotated, and a second cam surface which moves the sheet separating member towards and away from the sheet feeding roller at a predetermined timing when the cam is rotated;

a gear, connected to the first and second cam surfaces, having a section without gear teeth; and a drive gear which drives the gear connected to the first and second cam surfaces.

8. A sheet feeding apparatus according to claim 7, wherein:

the first cam surface and the second cam surface have shapes which cause a pressing of the sheet separating member against the sheet feeding roller to be earlier than a time when a sheet fed from the tray reaches a position at which the sheet is pressed between sheet separating member and the sheet feeding roller.

9. A sheet feeding apparatus according to claim 7, wherein:

the first cam surface and the second cam surface have shapes which cause a pressing of the sheet separating against the sheet feeding roller to be earlier than or simultaneous to a time when the tray starts moving towards the sheet feeding roller.

10. A sheet feeding apparatus according to claim 7, wherein:

the first cam surface and the second cam surface have shapes which cause a releasing of the tray from the sheet feeding roller to be just after an edge of the sheet fed by the sheet feeding roller is held between the sheet feeding roller and the sheet conveying roller.

11. A sheet feeding apparatus according to claim 7, wherein:

the first cam surface and the second cam surface have shapes which cause a releasing of the sheet separating member from the sheet feeding roller to be just after an edge of the sheet fed by the sheet feeding roller is held between the sheet feeding roller and the sheet conveying roller, and to be later than or simultaneous to a time when a pressure of the tray against the sheet feeding roller is released.

12. A sheet feeding apparatus according to claim 7, wherein:

the first cam surface and the second cam surface have shapes which cause a releasing of the tray from the sheet feeding roller to be just after an edge of the sheet is between the sheet feeding roller and the sheet conveying roller, and a pressure R1 of the sheet separating member against the sheet feeding roller is less than or equal to a pressure R2 of the tray against the sheet feeding roller.

* * * * *